United States Patent [19]

Guenther

[11] Patent Number: 4,461,935

[45] Date of Patent: Jul. 24, 1984

[54] VIDEO CONTROLLER SPRING MOUNTING

[75] Inventor: John L. Guenther, Aptos, Calif.

[73] Assignee: Texticon, Santa Clara, Calif.

[21] Appl. No.: 469,612

[22] Filed: Feb. 24, 1983

[51] Int. Cl.[3] ..... H01H 13/70; H01H 25/00

[52] U.S. Cl. ..... 200/5 R; 200/6 A; 200/17 R

[58] Field of Search ..... 200/5 R, 5 A, 6 A, 17 R, 200/18, 153 K, 292, 159 B

[56] References Cited

U.S. PATENT DOCUMENTS

| | | | |
|---|---|---|---|
| 4,246,452 | 1/1981 | Chandler | 200/292 X |
| 4,297,542 | 10/1981 | Shumway | 200/5 R X |
| 4,319,099 | 3/1982 | Asher | 200/5 A X |
| 4,349,708 | 9/1982 | Asher | 200/153 K X |
| 4,433,217 | 2/1984 | Griffith | 200/5 R |

*Primary Examiner*—J. R. Scott

*Attorney, Agent, or Firm*—Alan H. MacPherson; Thomas S. MacDonald

[57] ABSTRACT

In a hand video controller having two portions (11, 13) tiltable with respect to each other to make or break a series of spaced electrical switch contacts (26) to move a video cursor and having one-piece spring (47) having inner and outer connected rings (31, 33) to return the portions to a neutral position, an improved spring mounting comprising a mounting block (15) having a bearing recess (19) attached to one controller portion (11), a switch operator holding member (20) having a matching bearing surface extension (22) and attached to the other controller portion (13), switch contact means (27) between the block and holding member, and wherein the rings of the spring are connected respectively to and between the block and holding member and tilting movement of the controller portions deflect the spring rings and bring spaced flexible switch operators (28) extending from the holding member into contact with at least one of the switch contacts (26).

14 Claims, 3 Drawing Figures

VIDEO CONTROLLER SPRING MOUNTING

CROSS-REFERENCE TO RELATED APPLICATIONS

This application is an improvement to U.S. patent application Ser. No. 430,202 filed Sept. 30, 1982, entitled "Hand Controller Spring", invented by Frank E. White, and assigned to the same assignee as this application. The information in such application is herein incorporated by reference.

BACKGROUND OF THE INVENTION

1. Field of Invention

This invention relates to a hand-operated video controller and particularly to means for mounting a flat spring used to control tilting motion of the hand controller and to provide positive tilting movement and pressure to make and break a series of spaced electrical contacts to control for example, a video game cursor.

2. Prior Art

Video games use a hand controller as a means of communication between player and computer or other video screen device. The hand controller typically communicates desired movement of a cursor on the video screen. The hand controller top is tilted from a central position into an up, down, left or right position or, in some models, the four positions between the up, down, right and left positions, to communicate a corresponding movement of the cursor on the video screen. Movement in a particular direction makes or breaks electrical contacts connecting various circuits in the video game system. A spring automatically returns the controller to the central position and therefore stops movement of the cursor after the force tilting the controller top is removed and electical contact broken. The related application shows a one-piece spring which has connected outer and inner rings which are respectively mounted to planar plastic blanks which in turn are mounted to upper and lower portions of a video hand controller casing. A tied ball bearing is provided to provide for tilting movement of the spring and to allow the tilting action. A switch contact foil is provided between one of the blanks and a spacer so that tilting movement of a top portion of the controller with respect to a bottom portion makes and breaks electrical contacts which moves a video game cursor in up-down-left-right directions or combinations thereof. So-called "joy sticks" are also employed, such as seen in U.S. Pat. Nos. 4,124,787 and 4,349,708. These include an upstanding handle which may be tilted in any direction. Such movement forces a circular plastic operator against one or two electrical contacts and a concentric flexible boot attached to the handle and the casing along with an internal spring provides the restorative force to recenter the handle when the user's hand is removed from the handle.

SUMMARY OF THE INVENTION

The present invention provides an improved mounting for the spring shown in the related application which is easier and more economical to manufacture, is more compact and reliable, affords a more positive contact with the switch contact areas and provides a more reliable connection of the spring to the controller portions. A mounting block having a bearing recess is provided which is mounted within one portion of the controller casing. A switch operator holding member, having a bearing surface extension matching the bearing recess of the block forming a universal joint is attached to the other portion of the casing. An electrical switch contact foil extends between the block and holding member which is actuatable by a series of flexible switch operators extending from and held in the holding member. A flat tilt return spring having concentric rings is disposed between the holding member and the switch contact foil with the outer ring attached to the block and inner ring attached to the holding member. Tilting movement of one portion of the controller with respect to the other variously twists the rings of the spring and brings at least one of the switch operators, which are spaced in neutral or untilted position from the switch contact areas, into make and break contact with those areas.

DETAILED DESCRIPTION

Figure 1:
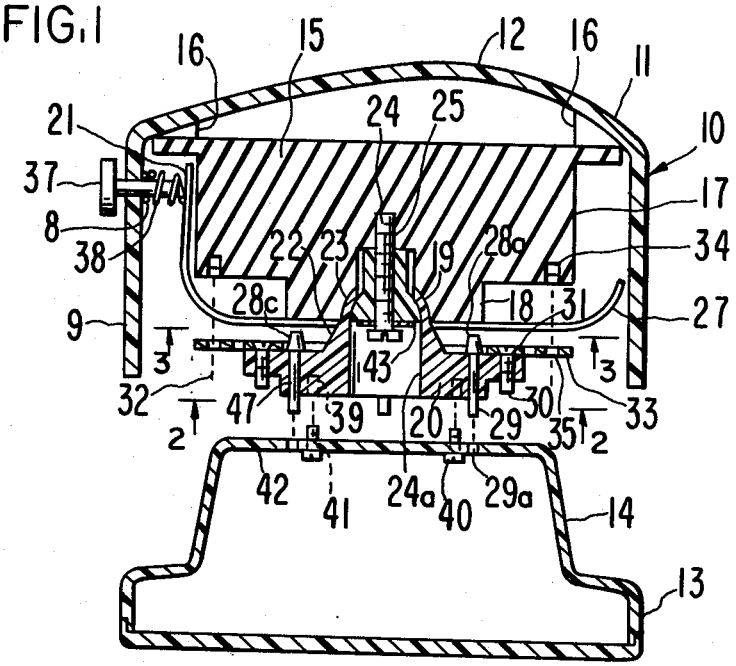
FIG. 1 is an exploded cross-sectional view of the hand controller and spring mounting of the invention.

The construction and operation of this invention is set forth with reference to the above drawings. FIG. 1 shows a cross-sectional view of the hand controller 10 which comprises an upper portion 11 and a lower base portion 13. Upper portion 11 has a upper surface 12 which may be manipulated by the palm of a user's hand so as to move or tilt top 11 with respect to base 13. Base 13 may contain an upper pedestal 14 extending towards the top portion 11. A block 15 is mounted by a fastening means or by adhesive bonding into ledges 16 on the interior surface of top 11. Top surface 12 is generally rectangular in plan view and block 15 generally conforms at its attaching face to such configuration. Other configurations such as an ovoidal top surface may be employed. Block 16 includes a depending section 17 forming a verical wall and a boss portion 18 extending downwardly. Boss 18 is circular in plan view and contains a circular recess 19 forming a bearing surface on its curved side edges.

A switch operator holding member 20 is provided, such holding member having an extension 22 upstanding from its surface. The extension has a bearing surface 23 which is placed in juxtaposed matched bearing contact with surface 19. Holding member 20 has a centrally located recess 24*a*. A screw 24 within the recess 24*a* threadedly connects the holding member to a threaded aperture 25 within block 15. A washer 43 is provided under the screw head and the inner surface of the extension 22 and the screw loosely tightened so as to still allow universal movement of the holding member bearing with the block 15.

A switch foil 27 is mounted on the bottom surface of boss 18 and contains a series of spaced switch contact areas 26 around its periphery. Series of switch operators 28*a*, 28*b*, 28*c* and 28*d* extend through apertures 47 in holding member 20. The switch operators comprise elongated flexible members made of rubber or other flexible insulative material having truncated conical outer ends which extend from the surface of member 20 and in neutral position are spaced from the contact areas 26 contained in the switch foil 27.

Figure 2:
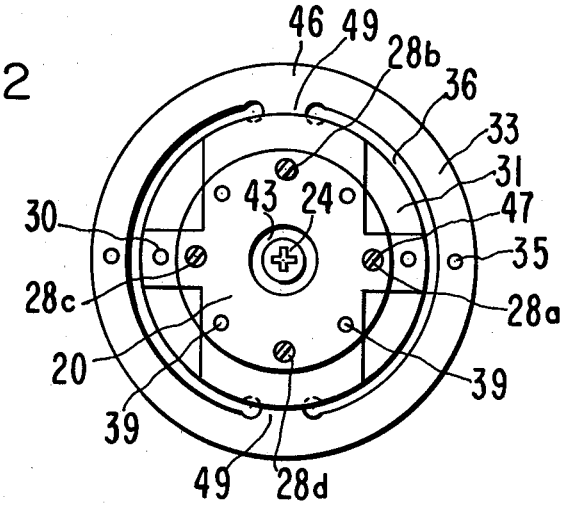
FIG. 2 is a bottom view of the spring assembly taken on line 2—2 of FIG. 1.

Spring 46, more clearly shown in FIG. 2, is comprised of two concentric connected rings. An inner ring 31 and an outer ring 33 are separated by a slit 36 which allows the rings to be twisted with respect to one another. Outer ring 33 is attached to block 15 by suitable fastening screws passing through apertures 35 in the outer ring into a threaded aperture 34 contained in the block 15. The inner ring 31 is threadedly connected to the holding member 20 by mounting screws 30. The top portion of the hand controller with the spring and switch mounting assembled on block 15 by screw 24 is then placed on the top surface 42 of pedestal 14. Suitable screws 40 are provided within pedestal 14 extending through apertures 41 into threaded recesses 39 in holding member 20 thus connecting the two portions of the hand controller. Suitable apertures 29*a* are provided in the top surface 42 of the pedestal through which the ends 29 of the switch operators may protrude. Since the switch operators are flexible, they may bend when the top section 11 is tilted with respect to bottom portion 13. The truncated end of a switch operator is pressed on a particular contact area when the controller top is tilted in the direction of that particular switch operator.

While not forming any part of the present invention, an auxiliary switch firing button(s) 37 is normally provided in a depending wall 9 of the top 11 to actuate an auxiliary switch 21 to fire a "projectile" or the like on the video screen as is commonly practiced in many video games. Button 37 has an operator portion extending through wall 9. A spring 38 extends between a retainer clip 8 on the button operator abutting an inner surface of the wall 9 and the switch foil contact portion 21 to return the switch to a non-firing position. The foil extension 21 is normally placed against the depending wall 17 of block 15.

FIG. 2 shows the spring utilized in this invention more clearly. Spring 46 comprises connected rings 31 and 33 which are spaced from each other by slit 36. Slit 36 extends approximately 170° on either side of the circular ring leaving a connecting bridge 49 between the inner and outer rings 31 and 33. Holding member 20 in plan view is a cross-shaped structure having arms contiguous to the outside diameter of inner ring 31. The periphery of the arms are curved to match the shape of the outside periphery of the inner ring. Holding member 20 contains a series of apertures 47 inboard of the inside diameter of inner ring 31 through which the switch operators 28*a*, 28*b*, 28*c* and 28*d* are held. Apertures 39 and associated screw means mount the top surface 42 of pedestal 14 to the holding member 20. Apertures 30 are provided to allow mounting of the inner ring 31 to the holding member. Apertures 35 on the outer ring allow for mounting the outer ring 33 to block 15.

Figure 3:
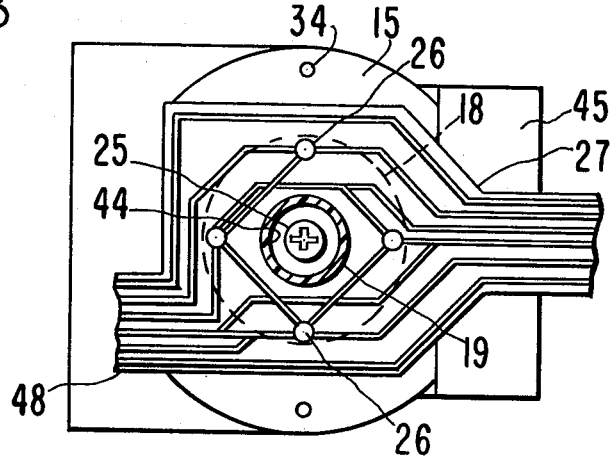
FIG. 3 is a bottom view of the switch contact means and mounting block taken on the line 3—3 of FIG. 1 with the holding member and spring disassembled therefrom.

FIG. 3 shows a view of the switch foil 27 mounted on the mounting block 15. Foil 27 comprises a plastic foil having a central section circular in plan view, which may be adhesively bonded to the circular top surface of boss 18. Foil 27 comprises a series of contact areas 26 spaced 90° apart on its surface with suitable conductive paths leading to the electrical controls for the controller device. An extension 48 is provided on the switch foil which conducts signals from the auxiliary switch(es) 21 contained in the foil section abutting the side 17 of the block 15. Aperture 44 provided centrally of the foil allows passage of the holding member extension 22 into the bearing recess 19 and the connection of screw 24 into the threaded aperture 25 contained in the mounting block. The switch foil is of conventional construction wherein two switch contacts are normally held apart and are pressable together upon contact by a switch operator. This is accomplished by the conical flat ends of switch operators 28*a*, 28*b*, 28*c* and 28*d* when the controller top portion 11 is tilted with respect to the controller bottom portion towards any one or two of the switch operators and the juxtaposed contacts.

The above descriptions of advantages and embodiments of this invention are intented to be illustrative and not limiting. Other embodiments of this invention will be apparent to those skilled in the art in view of the above disclosure.

I claim:

1. Means for mounting a spring for a switch mechanism contained in a two-part container, said spring having connected outer and inner rings, said rings being adaptable to be flexed with respect to each other, comprising, (a) a first mounting means mounted on one part of the container and having a curved bearing recess on one surface;

(b) means to mount one of said spring rings to said means;

(c) a switch operator holding member including an extension having a curved bearing surface in bearing contact with said mounting means recess and adapted for universal movement with respect to said recess;

(d) means to mount the other of said spring rings to said holding member whereby said spring is situated between said block and said holding member;

(e) electrical switch contact means extending between said block and said holding member;

(f) means to attach said holding member to the other part of the container, whereby said spring allows universal tilting motion between the two parts of said container; and (g) switch operators mounted in and extending from said holding member and spaced from said switch contact means in a non-tilting position of said container parts, at least one of said switch operators being movable into and out of contact with said switch contact means to make and break electrical contact when said parts are tilted with respect to each other.

2. The invention set forth in claim 1 wherein said electrical switch contact means includes means forming a central aperture in said extension and means extending from the interior of said extension through said recess to threadedly attach said holding member to said first mounting means while allowing relative movement therebetween.

3. The invention set forth in claim 1 wherein said switch operators and said means to attach extend through multiple apertures in said holding member radially inboard of said inner ring.

4. The invention set forth in claim 1 wherein said switch operators are flexible insulative inserts insertible in apertures in said holding member and extending outwardly and positioned above a series of electrical contact points in said switch contact means.

5. The invention set forth in claim 4 in which said inserts include a truncated conical end extending outwardly and above said contact points.

6. The invention set forth in claim 1 in which said holding member has a radial dimension substantially equal to the outside diameter of said inner ring.

7. The invention set forth in claim 1 in which said mounting means recess is contained in a circular boss extending from a surface of said mounting means, said boss having a diameter less than the diameter of said outer ring.

8. In a hand-operated video controller having a lower base portion and an upper portion wherein the portions are tilted relative to each other from a neutral position to make or break a series of spaced electrical contacts and spring means to return said portions to such normal neutral position, the improvement which comprises:

(a) means to mount a part of said spring to one of said controller portions;

(b) a switch operator holding member mounted to the other of said controller portions and being attached to a second part of said spring;

(c) electrical switch contact means extending between said holding member and a facing surface of said means to mount, (d) said spring means being deposed between said holding member and said switch contact means; and (e) switch operators extending from said holding member to a position spaced from said switch contact means in said neutral position, at least one of said switch operators being moveable into and out of contact with said switch contact means when said base portion and upper portion are tilted with respect to one another; and (f) universal joint means extending between said holding members and one of said controller portions permitting tilting of said controller portions with respect to each other.

9. The invention set forth in claim 8 in which said means to mount includes a mounting block fixedly mounted in said upper controller portion.

10. The invention set forth in claim 9 in which said mounting block includes a curved bearing recess, said holding member containing a matching curved bearing surface, said bearing recess and said curved bearing surface forming said universal joint means.

11. The invention set forth in claim 8 in which said switch operators are flexible insulative inserts insertible in apertures in said holding member and extending outwardly and positioned above a series of electrical contact points in said switch contact means.

12. The invention set forth in claim 11 in which said inserts include a truncated conical end extending outwardly and above said contact points.

13. The invention set forth in claim 8 in which said holding member is generally radially contiguous to said second part of said spring.

14. The invention set forth in claim 8 in which said spring means comprises connected inner and outer rings and said holding member is connected to the inner ring and is contiguous to the outside diameter of said inner ring.

* * * * *